US012264461B2

(12) United States Patent
Karunakaran et al.

(10) Patent No.: US 12,264,461 B2
(45) Date of Patent: Apr. 1, 2025

(54) HEEL SHROUD HAVING STRESS CONCENTRATION REDUCTION GEOMETRY AND ENHANCED DURABILITY

(71) Applicant: Caterpillar Inc., Peoria, IL (US)

(72) Inventors: Ezhil Valavan Karunakaran, Ariyalur (IN); Brandon Hammig McCaffrey, St. Louis, MO (US)

(73) Assignee: Caterpillar Inc., Peoria, IL (US)

( * ) Notice: Subject to any disclaimer, the term of this patent is extended or adjusted under 35 U.S.C. 154(b) by 327 days.

(21) Appl. No.: 17/690,431

(22) Filed: Mar. 9, 2022

(65) Prior Publication Data

US 2023/0287664 A1 Sep. 14, 2023

(51) Int. Cl.
*E02F 9/28* (2006.01)

(52) U.S. Cl.
CPC ..... *E02F 9/2883* (2013.01); *E02F 9/2808* (2013.01)

(58) Field of Classification Search
CPC ..... E02F 9/2883; E02F 9/2858; E02F 9/2825; E02F 9/2833; E02F 9/2816; E02F 9/2808; E02F 9/28; E02F 9/285; E02F 3/40; E02F 3/401; E02F 3/8152
USPC ..... 37/455
See application file for complete search history.

(56) References Cited

U.S. PATENT DOCUMENTS 3,001,591 A * 9/1961 Johnson ..... A01B 15/025 172/752
4,052,802 A 10/1977 Moen et al.
4,129,952 A 12/1978 Olson
4,208,816 A 6/1980 West
4,407,081 A 10/1983 Hanson
4,716,666 A * 1/1988 Potter ..... E02F 9/2883 37/448
5,713,145 A * 2/1998 Ruvang ..... E02F 9/2833 37/458
9,725,875 B2 8/2017 Congdon
9,995,021 B2 * 6/2018 Serrurier ..... E02F 9/2883
10,060,099 B2 8/2018 Serrurier et al.
10,183,709 B2 1/2019 Kim
10,562,574 B2 2/2020 Dumitru
(Continued)

FOREIGN PATENT DOCUMENTS

CN 111576531 A 8/2020
WO 2011156834 12/2011
(Continued)

OTHER PUBLICATIONS

"How Corner Radius Affects CNC Machining", Protocase, https://www.protocase.com/blog/2020/03/06/how-corner-radius-affects-cnc-machining/ (Year: 2020).*
(Continued)

*Primary Examiner* — Jamie L McGowan
*Assistant Examiner* — Audrey L Lusk

(57) ABSTRACT

A heel shroud includes a bottom leg, and a side leg extending orthogonally from the bottom leg, forming an interior corner with the bottom leg. The heel shroud defines a first lateral surface, a second lateral surface, and the bottom leg includes a curved interior surface extending from the first lateral surface to the second lateral surface at least partially forming the interior corner. The first lateral surface defines a stress reduction geometry positioned at the interior corner, or includes a wear member that is attached to the side leg, or the bottom leg.

14 Claims, 10 Drawing Sheets

(56) References Cited

U.S. PATENT DOCUMENTS

| | | | | |
|---|---|---|---|---|
| 10,995,478 | B2 | 5/2021 | Bilal et al. | |
| 11,111,655 | B2 | 9/2021 | Pratt | |
| 11,220,806 | B2 * | 1/2022 | Lombardo | E02F 9/2883 |
| 2010/0275473 | A1 * | 11/2010 | Maher | C22C 37/08 37/453 |
| 2013/0160335 | A1 * | 6/2013 | Maher | E02F 9/285 37/453 |
| 2014/0173949 | A1 * | 6/2014 | Karlsson | E02F 9/2833 37/455 |
| 2016/0130791 | A1 * | 5/2016 | Serrurier | E02F 9/2883 37/450 |
| 2017/0284073 | A1 | 10/2017 | Kunz | |
| 2019/0040609 | A1 * | 2/2019 | Wilson | B23K 31/025 |

FOREIGN PATENT DOCUMENTS

| | | | | |
|---|---|---|---|---|
| WO | WO-2011156834 | A1 * | 12/2011 | E02F 9/2825 |
| WO | 2012000023 | | 1/2012 | |
| WO | WO-2012000023 | A1 * | 1/2012 | E02F 9/285 |
| WO | 2012017192 | A1 | 2/2012 | |

OTHER PUBLICATIONS

"Chocky Bars & Wear Buttons", Costex, https://www.costex.com/chocky-bars-wear-buttons/ (Year: 2021).*

* cited by examiner

HEEL SHROUD HAVING STRESS CONCENTRATION REDUCTION GEOMETRY AND ENHANCED DURABILITY

TECHNICAL FIELD

The present disclosure relates to heel shrouds that are used to protect the work implements such as the buckets of heavy equipment such as hydraulic mining shovels, and the like. Specifically, the present disclosure relates to such heel shrouds that may have stress concentration reduction geometry and/or enhanced durability features.

BACKGROUND

In various mining applications, the curved shell of a bucket or other work implement used by heavy equipment such as hydraulic mining shovels, and the like are subjected to heavy loads and/or abrasive environments. Accordingly, heel shrouds may be provided that are intended to extend the life of the bucket. However, the amount of material needed to create such heel shrouds may increase the cost and may necessitate sections that act as stress risers or the like. This may lead to unwanted maintenance of the heel shroud or its work implement early on its useful life at a higher cost than desired.

U.S. Pat. No. 10,562,257 B2 (the '257 patent) discloses a track slider used on heavy equipment such as electric roper shovels or the like. The slider includes an elongated base portion that is coupled to a frame, and a sliding portion extending from the elongated base portion. The sliding portion includes an outer surface that is configured to slidably engage with a track link of the track assembly. The sliding portion includes a set of wear indicators that are defined in the outer surface. The set of wear indicators includes a first wear indicator, and a second wear indicator. The first and the second wear indicators are located at a first predefined thickness, and a second predefined thickness respectively, measured along a central axis of the sliding portion. Further, the first wear indicator indicates partial wear of the sliding portion, and the second wear indicator indicates substantial wear of the sliding portion. However, the '257 patent is silent about possible stress reduction geometry for heel shrouds.

On the other hand, U.S. Pat. No. 4,052,802 A (the '802 patent) discloses ground engaging tools with a plurality of wear-resistant inserts. According to the '802 patent, the wear-resistant inserts are secured in between ribs which minimize the spalling of the inserts in use. However, the '802 patent is silent how to add durability to the heel shrouds having a right angled configuration for protecting the curved shell of a bucket or the like.

Accordingly, heel shrouds that may have features for increasing their useful life are still needed.

SUMMARY

A heel shroud according to an embodiment of the present disclosure may include a bottom leg, and a side leg extending orthogonally from the bottom leg, forming an interior corner with the bottom leg. The heel shroud may also define a first lateral surface, a second lateral surface, and the bottom leg may include a curved interior surface extending from the first lateral surface to the second lateral surface at least partially forming the interior corner. The first lateral surface may define a stress reduction geometry that is disposed at the interior corner, or may include a wear member that is attached to the side leg, and another wear member that is attached to the bottom leg.

A heel shroud according to another embodiment of the present disclosure may comprise a bottom leg, and a side leg extending orthogonally from the bottom leg, forming an interior corner with the bottom leg. The heel shroud may also define a first lateral surface, a second lateral surface, and the bottom leg may include a curved interior surface extending from the first lateral surface to the second lateral surface at least partially forming the interior corner, and a flat bottom surface that defines a lower wear member receiving pocket.

A heel shroud according to yet another embodiment of the present disclosure may comprise a bottom leg, and a side leg extending orthogonally from the bottom leg, forming an interior corner with the bottom leg. The heel shroud may also define a first lateral surface, a second lateral surface, and the bottom leg may include a curved interior surface extending from the first lateral surface to the second lateral surface, at least partially forming the interior corner. A flat bottom surface may define a lower wear member receiving pocket, and the side leg may define a side wear member receiving pocket that is in communication with the lower wear member receiving pocket.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings:

FIG. 6 is a perspective view of another embodiment of a heel shroud similar or identical to that of FIG. 3 except that durability enhancements are added such as chocky bars or the like.

DETAILED DESCRIPTION

Figure 1:
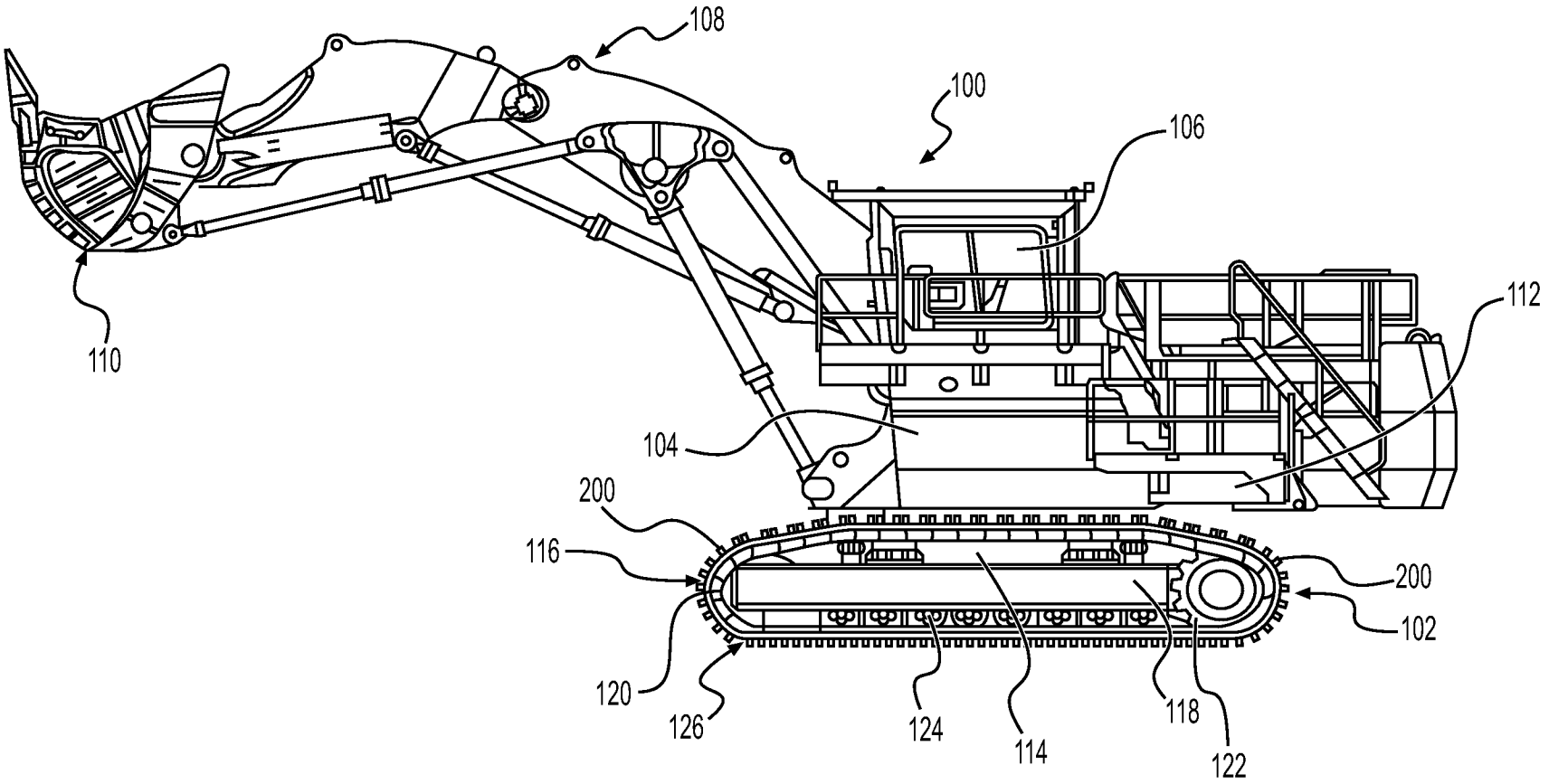
FIG. 1 illustrates a machine in the form of a hydraulic mining shovel that has a work implement in the form of a bucket with heel shrouds constructed according to the various embodiments disclosed herein.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification.

While the arrangement is illustrated in connection with a hydraulic mining shovel, the arrangement disclosed herein has universal applicability in various other types of machines commonly employ track systems, as opposed to wheels. The term "machine" may refer to any machine that performs some type of operation associated with an industry such as mining, earthmoving, or construction, or any other industry known in the art. For example, the machine may be an excavator, wheel loader, cable shovel, or dragline or the like. Moreover, one or more implements may be connected to the machine. Such implements may be utilized for a variety of tasks, including, for example, lifting and loading. Among other uses, a hydraulic mining shovel can be used to load overburden and ore into haul trucks during the mining process in various surface mine applications.

Looking at FIG. 1, a machine 100 such as a hydraulic mining shovel that may use a work implement 110 such as a bucket using heel shrouds 200, 300 constructed according to various embodiments of the present disclosure can be seen. The machine 100 may include a body 104 with a cab 106 to house a machine operator. The machine may also include a boom system 108 pivotally connected at one end to the body 104 and supporting an implement 110 at an opposing, distal end. In embodiments, the implement 110 can be any suitable implement, such as a bucket, a clamshell, a blade, or any other type of suitable device. A control system can be housed in the cab 106 that can be adapted to allow a machine operator to manipulate and articulate the implement 110 for digging, excavating, or any other suitable application.

The body 104 may be supported on a main frame 112 supported on an undercarriage structure 114. The undercarriage structure 114 includes a supporting structure 118 that supports a track system 102 utilized for movement of the machine 100. The track system 102 may include first and second track roller frame assemblies 116, which are spaced from and adjacent respective first and second sides of the undercarriage structure 114. It will be appreciated that only one of the track roller frame assemblies 116 is visible in FIG. 1.

Each of the track roller frame assemblies 116 carries an idler wheel 120, a drive sprocket wheel 122, and a plurality of track guiding rollers 124. The drive sprocket wheel 122 is powered in forward and reverse directions by the machine 100 (via a motor such as an internal combustion engine). An endless track chain assembly 126 encircles each drive sprocket wheel 122, the idler wheel 120, and the track guiding rollers 124. The track chain assembly 126 includes a plurality of interconnected track pads 128. The track guiding rollers 124 guide the track pads 128 as the track chain assembly 126 is driven by the drive sprocket wheel 122.

Figure 2:
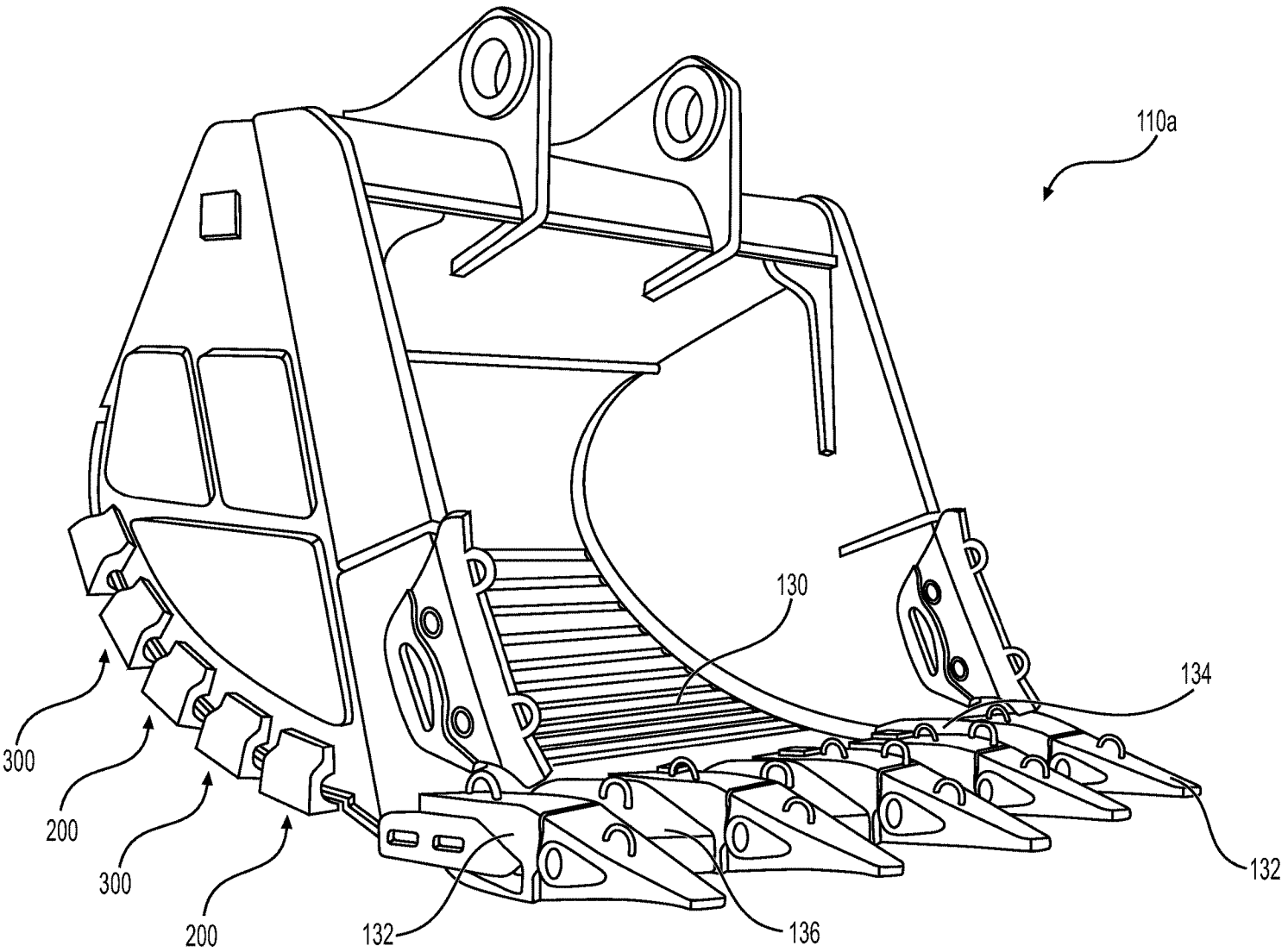
FIG. 2 is a perspective view of bucket of FIG. 1 as well as its heel shrouds removed from the machine for enhanced clarity.

Looking at FIG. 2, the bucket 110*a* may have a curved shell 130 to which one or more heel shrouds 200, 300 configured according to various embodiments of the present disclosure may be attached via welding, fastening, etc. Also, a plurality of tips 132, adapters 134, and shrouds 136 may be attached to the front lip 138 of the bucket.

Turning now to FIGS. 3 thru 5, and 8, various embodiments of a heel shroud 200, 300 that may have one more features for indicating wear, and reducing stress or wear will now be discussed.

Figure 3:
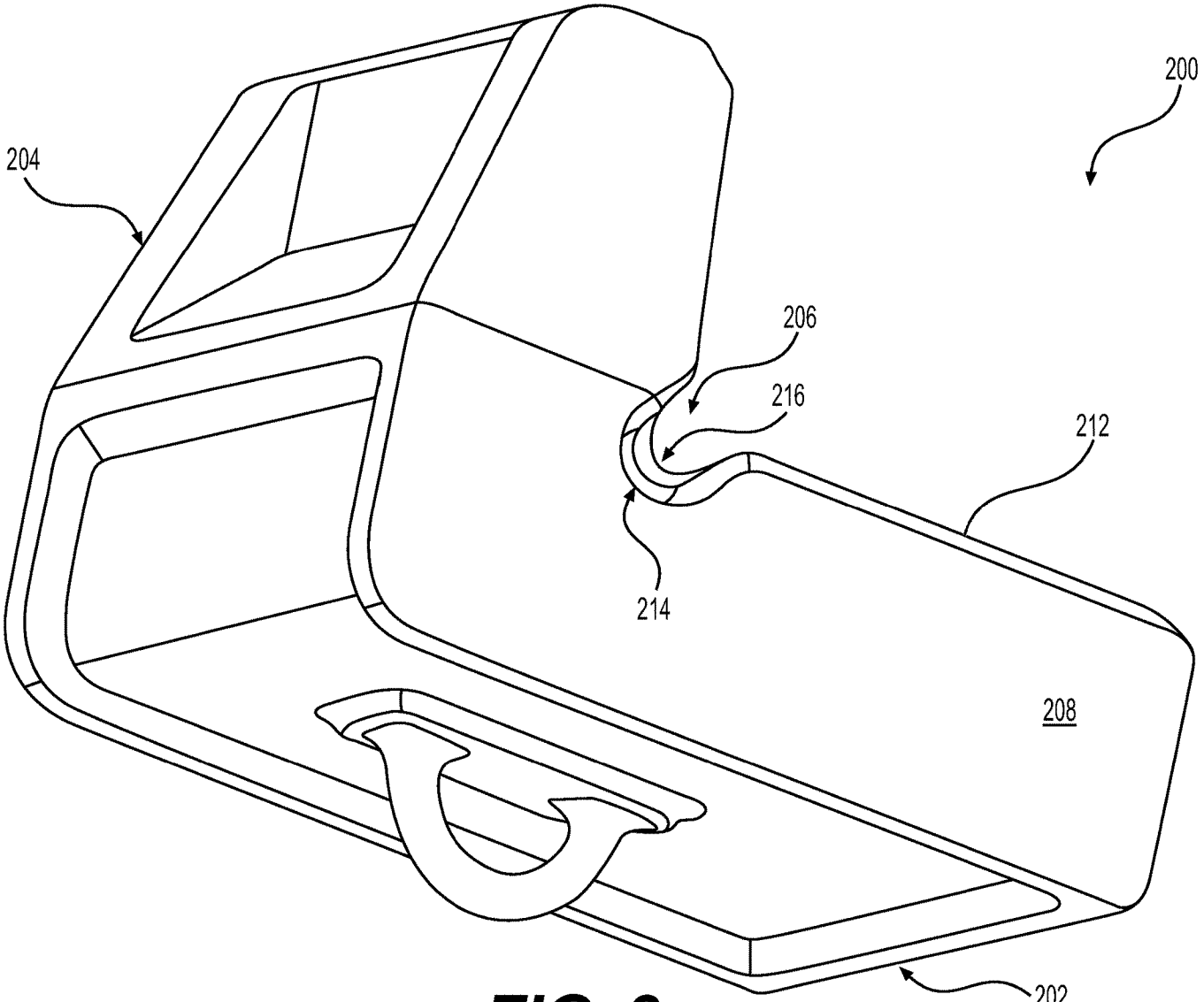
FIG. 3 is a perspective view of a heel shroud removed from the bucket of FIG. 2, constructed according to an embodiment of the present disclosure that includes stress reduction geometry in its interior corner.
Figure 4:
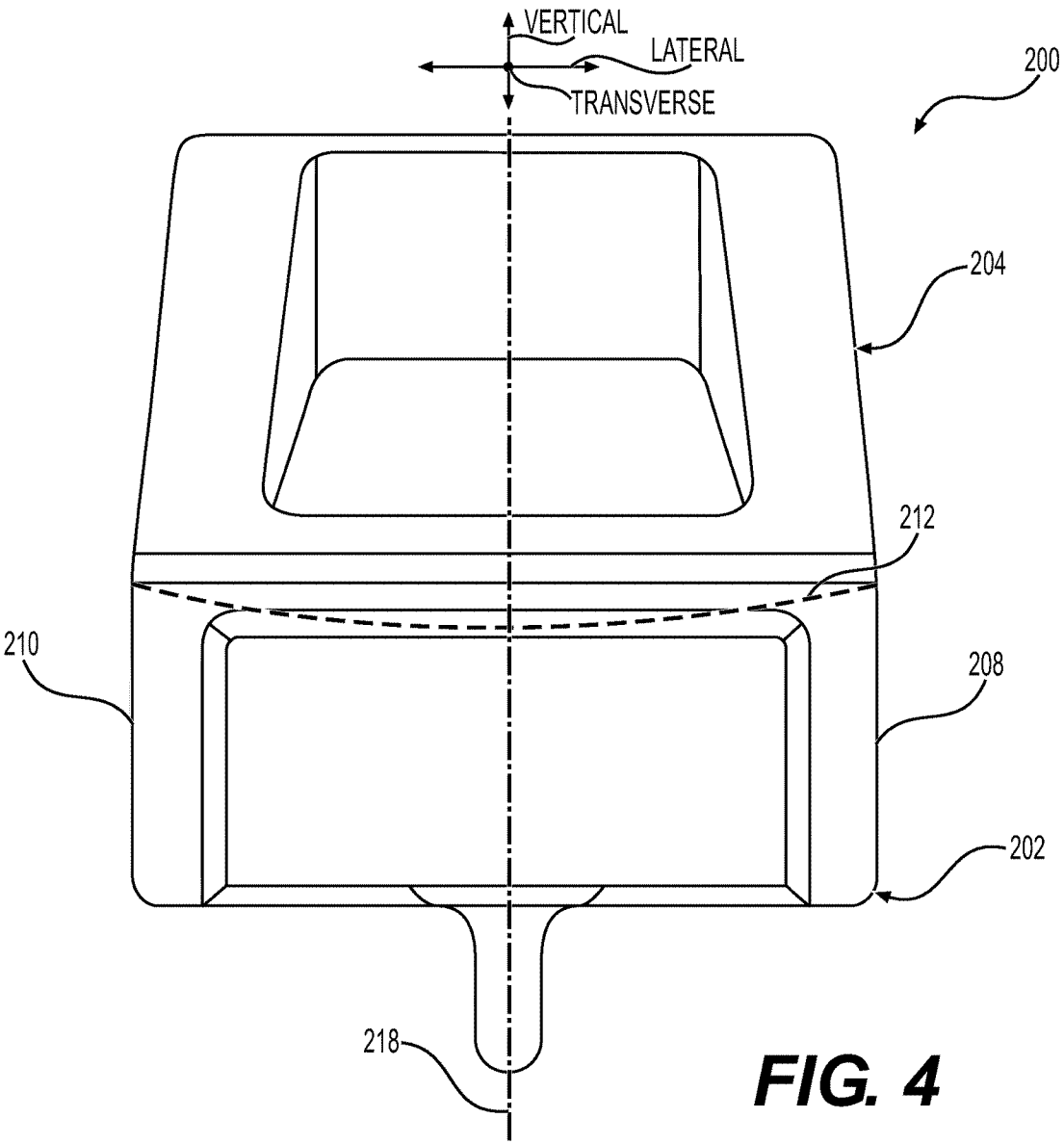
FIG. 4 is a front view of the heel shroud of FIG. 3.
Figure 5:
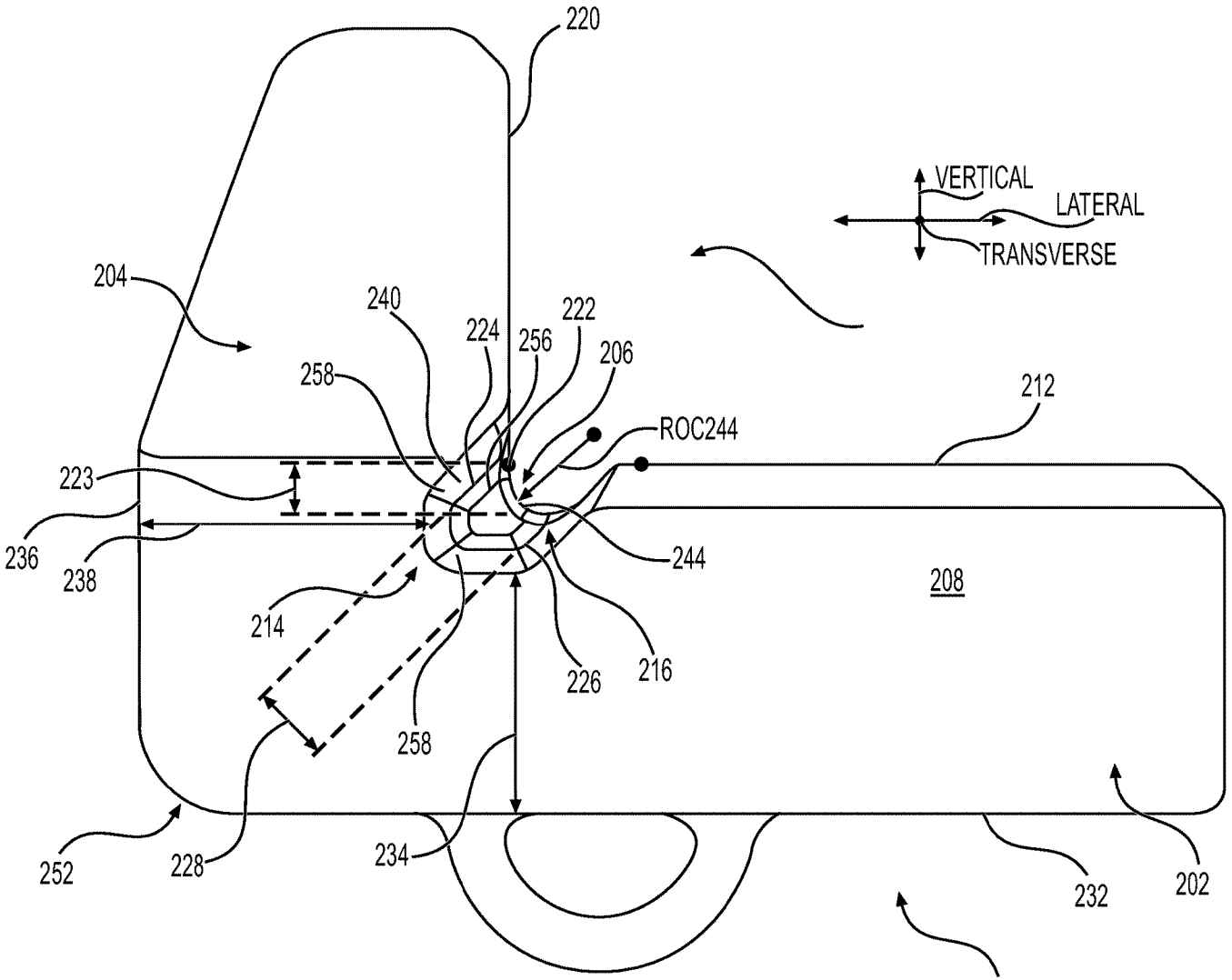
FIG. 5 is a side view of the heel shroud of FIG. 4.

Starting with FIGS. 3 thru 5, such a heel shroud 200 may comprise a bottom leg 202, and a side leg 204 extending orthogonally from the bottom leg 202. This may resemble a L-shaped body with an interior corner 206 formed by the intersection of the side leg 204 with the bottom leg 202. Also, the heel shroud 200 may define a first lateral surface 208, a second lateral surface 210, and the bottom leg may include a curved interior surface 212 that is intended to mate with the curved shell of the bucket, or the like. This curved interior surface 212 (see also FIG. 9) may extend from the first lateral surface 208 to the second lateral surface 210 at least partially forming the interior corner 206.

Figure 8:
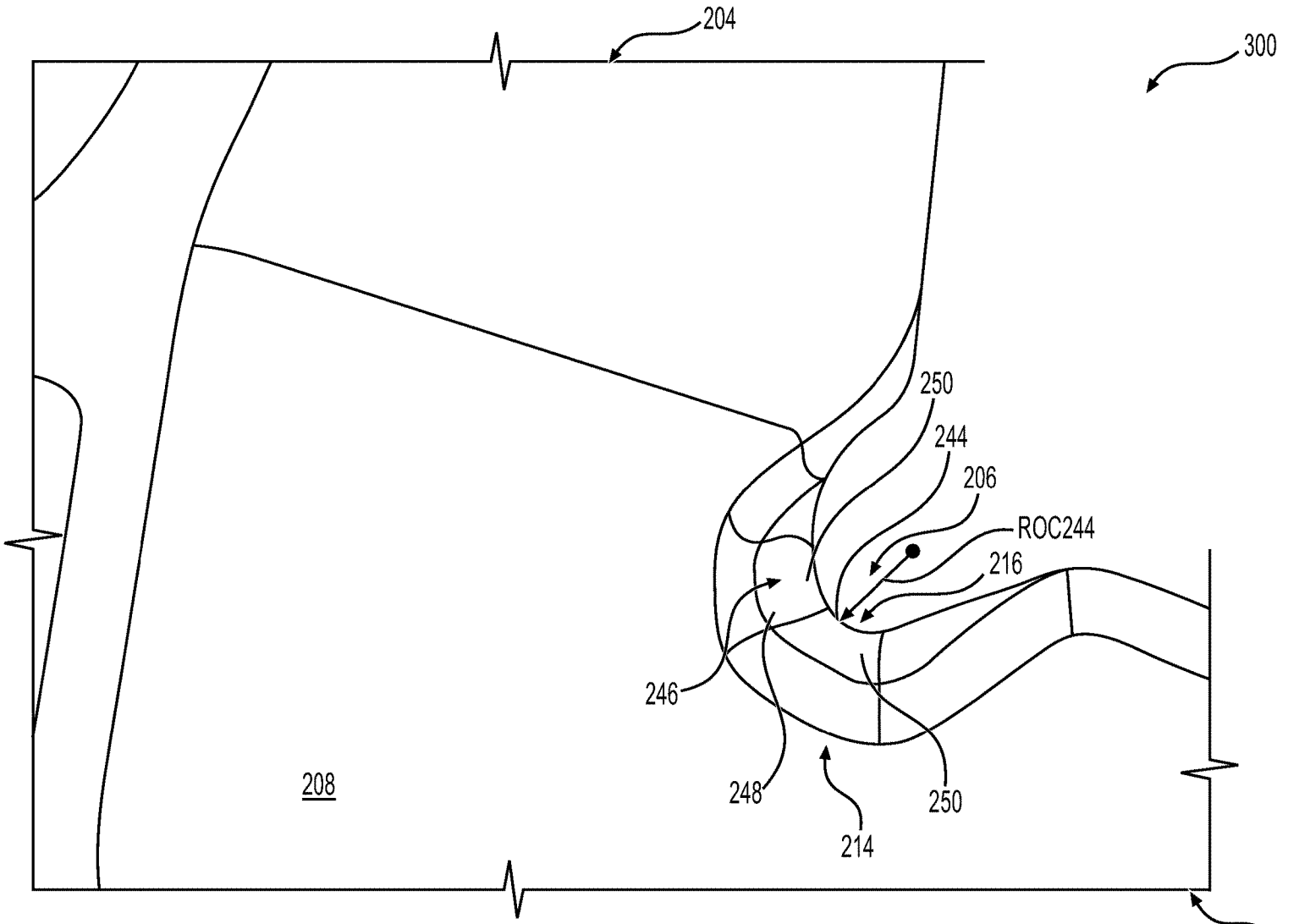
FIG. 8 is an enlarged detail view of the heel shroud of FIG. 6, showing its stress reduction geometry more clearly.

As best seen in FIGS. 5 and 8, the first lateral surface 208 may define a first wear indicator 214 and/or a stress reduction geometry 216 that is disposed at the interior corner 206. In some embodiments, the same geometry may serve both functions as shown in FIGS. 5 and 8, but not necessarily so. In some embodiments, only a wear indicator or a stress reduction geometry may be provided.

Figure 9:
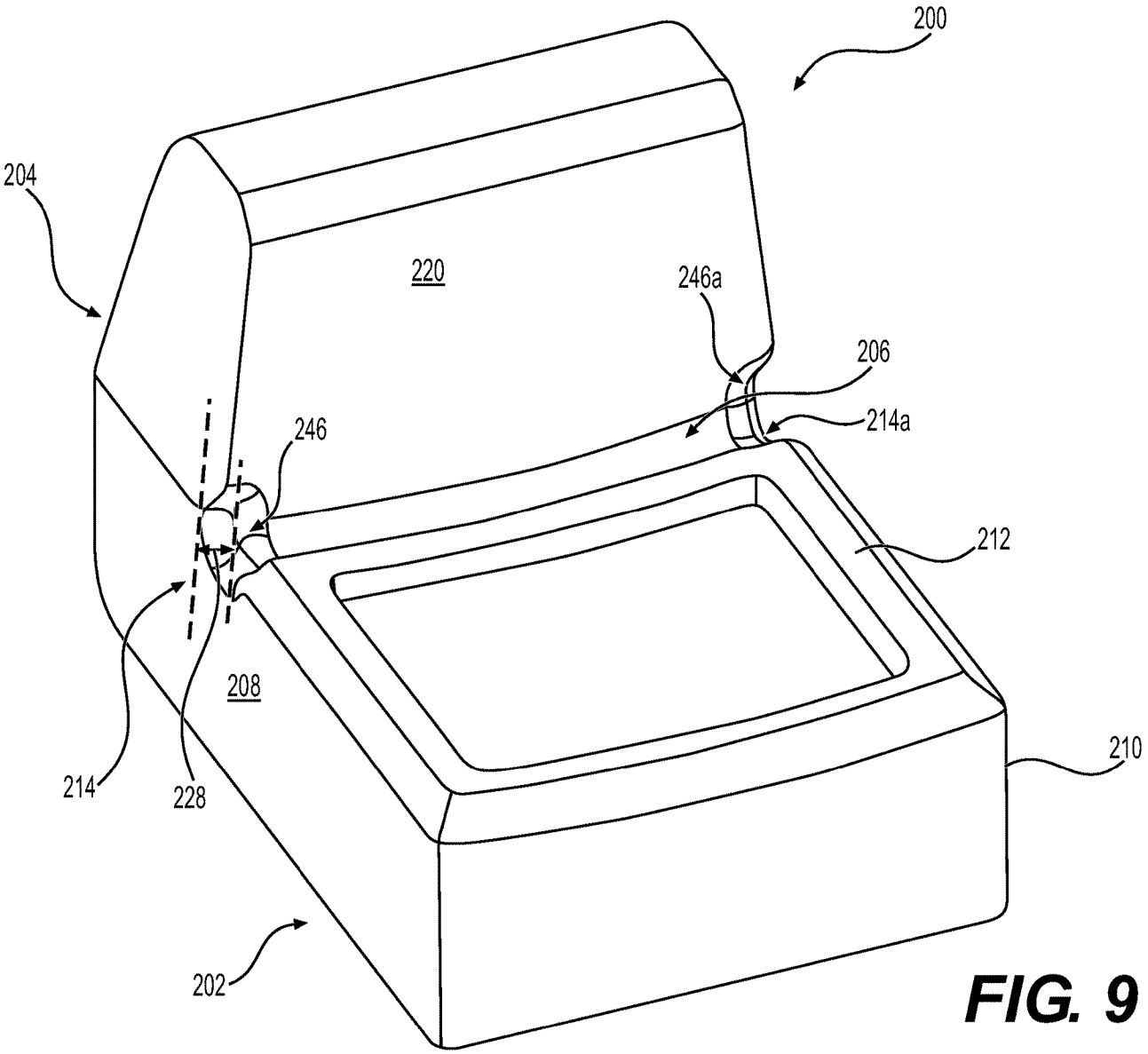
FIG. 9 is a rear oriented perspective view of the heel shroud of FIG. 6.

Focusing on FIGS. 3 thru 5, the wear indicator 214 will now be discussed in detail. It should be noted for any of the embodiments discussed herein, a lateral midplane as shown in FIG. 4 may represent a plane of symmetry 218 such that all or nearly all of the features of the heel shroud 200 are symmetrical about this plane. Accordingly, the second lateral surface 210 is understood to also define a second wear indicator 214*a* that is symmetrical to the first wear indicator 214 (as also shown in FIG. 9). This may not be the case for other embodiments of the present disclosure.

Looking at FIG. 5, the side leg 204 may define a planar interior surface 220 that at least partially forms the interior corner 206 or leads to this corner. The interior corner may be configured to provide corner relief, being spaced away a predetermined distance 223 from a theoretical sharp corner 222 defined by the intersection of the planar interior surface 220 of the side leg 204, and the curved interior surface 212 of the bottom leg 202.

The first wear indicator 214 defines a top angled wall 224 (so called since it extends neither purely horizontally or vertically oriented), a bottom angled wall 226 that is parallel to the top angled wall 226, and a gap distance 228 measured perpendicularly to the top angled wall 224, and the bottom angled wall 226.

Referring to FIGS. 5 and 9 together, the first wear indicator 214 may define a lateral depth 230, and a ratio of the gap distance 228 to the lateral depth 230 may range from 0.8 to 1.2 in some embodiments of the present disclosure.

In FIG. 5, the bottom leg 202 may define a bottom exterior surface 232, a first minimum distance 234 measured from the first wear indicator 214 to the bottom exterior surface 232, and the side leg 204 defines a side exterior surface 236, and a second minimum distance 238 that is measured from the first wear indicator 214 to the side exterior surface 236. It is to be understood that these dimensions are measured in the first lateral plane 208 (or projected on this plane and then measured) as shown in FIG. 5. A ratio of the first minimum distance 234 to the second minimum distance 238 ranges from 0.75 to 1.0 in some embodiments of the present disclosure, or vice versa.

Specifically as shown in FIG. 5, the first wear indicator 214 may include a vertical surface 240 that at least partially defines the second minimum distance 238, and a horizontal surface 242 (may also be referred to as a "horizontal surface") that at least partially defines the first minimum distance 234.

Focusing now on FIG. 8, a stress concentration reducing geometry 216 is shown at the interior corner 306 including a concave arcuate surface 244. More particularly, this stress reduction geometry 216 includes a first pocket 246 that extends from the concave arcuate surface 244 that has a pocket floor surface 248 that is connected to the concave arcuate surface 244 by a plurality of convex arcuate surfaces 250 (see also FIG. 5).

As best seen in FIG. 5, the concave arcuate surface 244 may define a radius of curvature ROC244 that may range from 5.0 mm to 12.0 mm (e.g., about 8.0, 8.5, or 9.0 mm in some embodiments. As alluded to earlier herein with reference to FIG. 9, a second pocket 246*a* (and hence another stress reduction geometry) that is symmetrical to the first pocket 246 may be provided.

Referring again to FIGS. 5 and 8 simultaneously, the first pocket 246 may include a first planar sidewall (e.g., the top angled wall 224) extending from the pocket floor surface 248 to the first lateral surface 208, as well as a second planar sidewall (e.g., the bottom angled wall 226) extending from the pocket floor surface 248 to the first lateral surface 208. These walls may be parallel, but not necessarily so.

In FIG. 5, the bottom leg 202, and the side leg 204 also intersect at an exterior corner 252, and the first pocket 246 extends toward the exterior corner 252 in some embodiments of the present disclosure. In addition, a concave curved surface 254 (as used herein, "curved" may be interpreted as "arcuate" having a non-planar shape) may extend from the first planar sidewall (e.g., see the top angled wall 224) to the second planar sidewall (e.g., see the bottom angled wall 226). A plurality of concave arcuate blends 256 may extend from the pocket floor surface t248 toward the first planar sidewall, the second planar sidewall, and the concave curved surface 254. Similarly, a plurality of convex arcuate blends 258 may extend from the first planar sidewall, the second planar sidewall, and the concave curved surface 254 to the first lateral surface 208.

These various curved or arcuate surfaces may help reduce stress concentrations, helping to prolong the useful life of the heel shroud. As will be discussed later herein, the inventor(s) has performed FEA (finite element analysis) showing that this geometry will reduce the stress concentration of the heel shroud in use.

A heel shroud 300 that may have some stress reduction geometry 216 and/or a wear member 400, 500, 600 that is attached to the side leg 304, and/or a wear member 400, 500, 600 that is attached to the bottom leg 302 will now be discussed with reference to FIGS. 6 and 7. The wear members may be characterized as "enhanced" such that they wear slower or are more durable than the cast heel shroud that is typically manufactured from iron, grey cast-iron, etc. For example, any of the "wear members" described herein may be manufactured from chrome white iron that is heat-treated to an ASTM Class 2 category, Type B with a minimum hardness of Rockwell Scale C for high wear resistance.

Geometrically speaking, the bottom leg 302 includes a curved interior surface 312 extending from the first lateral surface 308 to the second lateral surface 310 at least partially forming the interior corner 306, and a flat bottom surface 314 that defines a lower wear member receiving pocket 316. Likewise, the side leg 304 may define an exterior planar surface 318 that defines a side wear member receiving pocket 320. As shown, the lower wear member receiving pocket 316, and the side wear member receiving pocket 320 are contiguous, forming a L-shaped cavity 322. They may be separated by a rib or other structure in other embodiments of the present disclosure.

Figure 7:
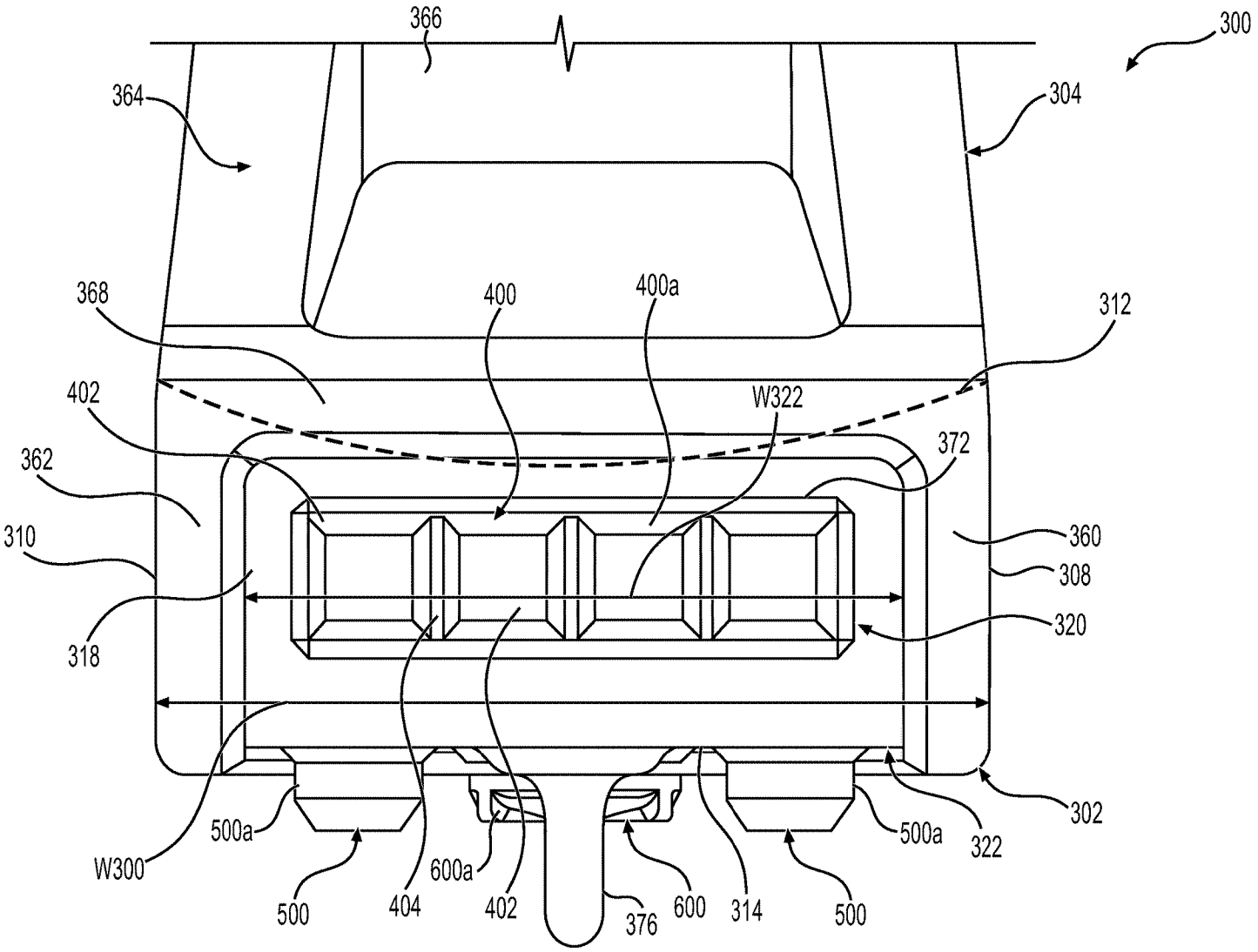
FIG. 7 is a front view of the heel shroud of FIG. 6.

Focusing on FIG. 7, the heel shroud 300 defines a lateral width W300 measured from the first lateral surface 308 to the second lateral surface 310, and the L-shaped cavity 322 may define a lateral cavity width W322. A ratio of the lateral width of the heel shroud to the lateral cavity width may range from 1.09 to 1.32 in some embodiments of the present disclosure. As a result, the L-shaped cavity 322 may be bound by a first lateral rib 360, and a second lateral rib 362 that is symmetrical to the first lateral rib 360 (about a lateral midplane such as explained earlier herein). These ribs may provide protection to the wear members and their mounting structure.

Also, the side leg 304 may include a tapered portion 364 (i.e., tapers toward the interior surface of the side leg) including an exterior top cavity 366 that is disposed vertically above the side wear member receiving pocket 320, being separated from the side wear member receiving pocket 320 by a laterally extending rib 368. One more of these features may be omitted in other embodiments of the present disclosure.

A laterally extending wear member 400 may be disposed in the side wear member receiving pocket 320. As shown, this wear member 400 may take the form of a chocky bar 400*a* with four sections 402 that are separated by V-notches 404 to add in the removal of sections to adjust the length of the chocky bar.

Figure 6:
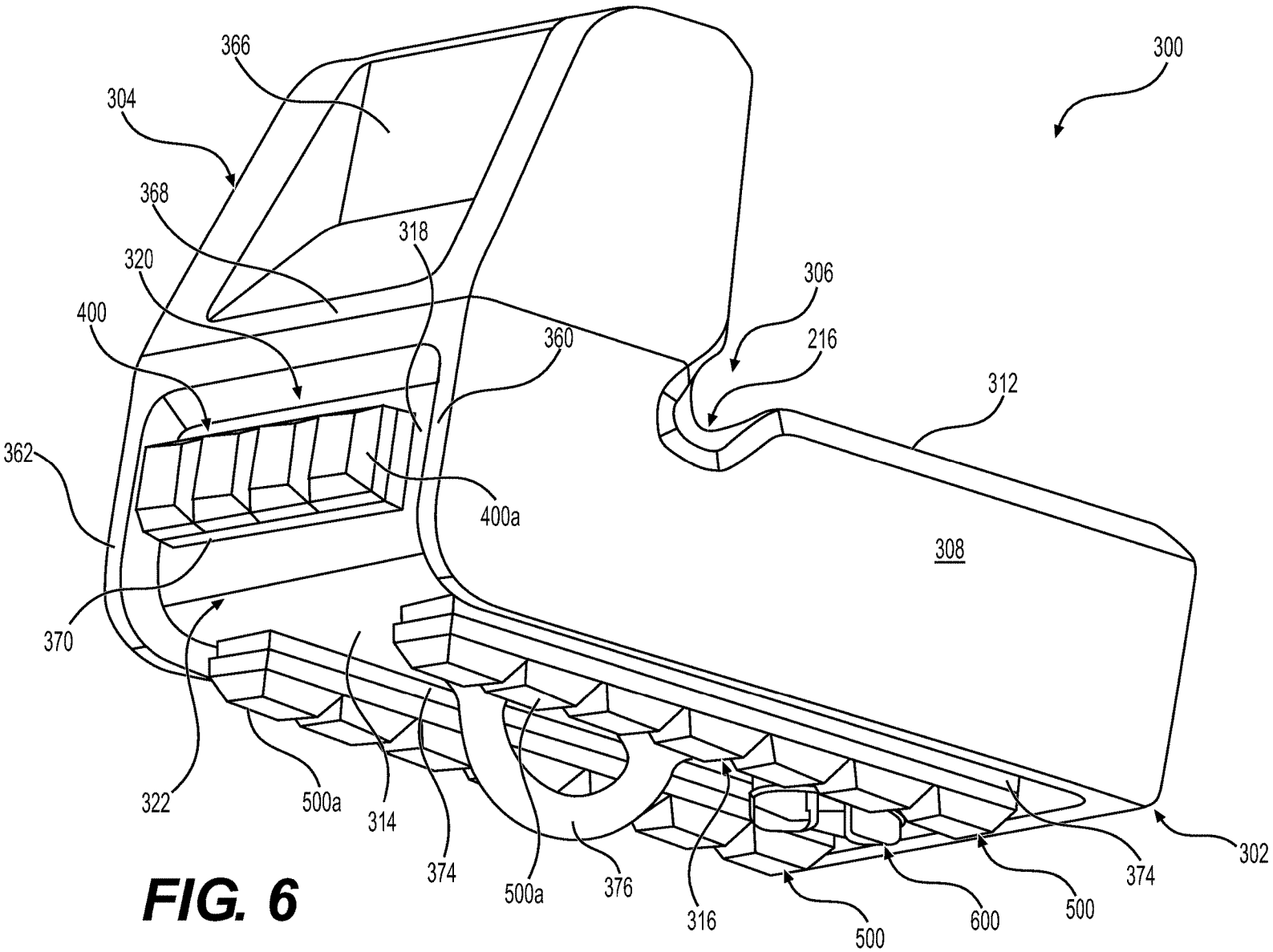

As best seen in FIG. 6, a mounting plate 370 is interposed between the side leg 304 and the chocky bar 400*a*. Fillet welds 372 (see FIG. are used to attach the mounting plate, and the chocky bar to the side leg. Other forms of attachment such as fastening may be employed in other embodiments of the present disclosure. Any of the "mounting plates" discussed herein may be manufactured from a mild-steel back plate that may provide impact absorption for greater durability.

In addition, a pair of transversely extending wear members 500 may be disposed in the lower wear member receiving pocket 316. Similar mounting techniques are used including providing a pair of mounting plates 374 that are interposed between the bottom leg 302, and the pair of transversely extending wear members 500. In this instance, the pair of transversely extending wear members 500 are also chocky bars 500*a* with seven sections 502, etc. A lifting hook 376 may be disposed laterally between the pair of transversely extending wear members 500. The hook may be located in other positions such as at the top of the side leg in other embodiments of the present disclosure. Another wear member 600 in the form of a wear button 600*a* is also employed, being disposed laterally between the pair of transversely extending wear members 500. This may not be the case in other embodiments of the present disclosure.

Another embodiment of the heel shroud 300 may be described as follows referring to FIGS. 6 and 7. The flat bottom surface 314 defines a lower wear member receiving pocket 316, while the side leg 304 defines a side wear member receiving pocket 320 that is in communication with the lower wear member receiving pocket 316. A first wear member (e.g., see 500 or 600) may be disposed in the lower wear member receiving pocket 316, while a second wear member (e.g., see 400) may be disposed in the side wear member receiving pocket 320.

For example, the first wear member may be one of chocky bar 500*a* or a wear button 600*a*, and the second wear member may be the other of a chocky bar 400*a* or a wear button. As depicted in FIGS. 6 thru 8, the first wear member is a chocky bar 500*a*, and the second wear member is a wear button 600*a*. In this instance, a pair of chocky bars disposed laterally on either side of the wear button. This may not be the case in other embodiments of the present disclosure. Also, a lifting hook 376 extends transversely from adjacent the wear button 600*a* toward the side leg 304.

The heel shroud may be a unitary body as shown or be an assembly of different parts including wear members, mounting plates, etc. Often, the heel shroud consists essentially of a metallic material such as cast iron, steel, grey cast iron, etc.

Any of the aforementioned features and their associated dimensions may be altered to be different than what has been shown or mentioned herein in other embodiments of the present disclosure.

INDUSTRIAL APPLICABILITY

In practice, a work implement, a bucket, and a heel or a portion thereof may be sold, manufactured, bought etc. and attached to the machine in the aftermarket or original equipment scenarios according to any of the embodiments discussed herein. That is to say, the machine may be sold with the work implement, or bucket, and/or heel shroud and/or portion thereof according to embodiments described herein or the machine may be retrofitted, repaired, refurbished to use any of the embodiments discussed herein. The various components including, but not limited to the heel shrouds, may be fabricated from any suitable material such as cast iron, grey cast iron, steel, etc.

Figure 10:
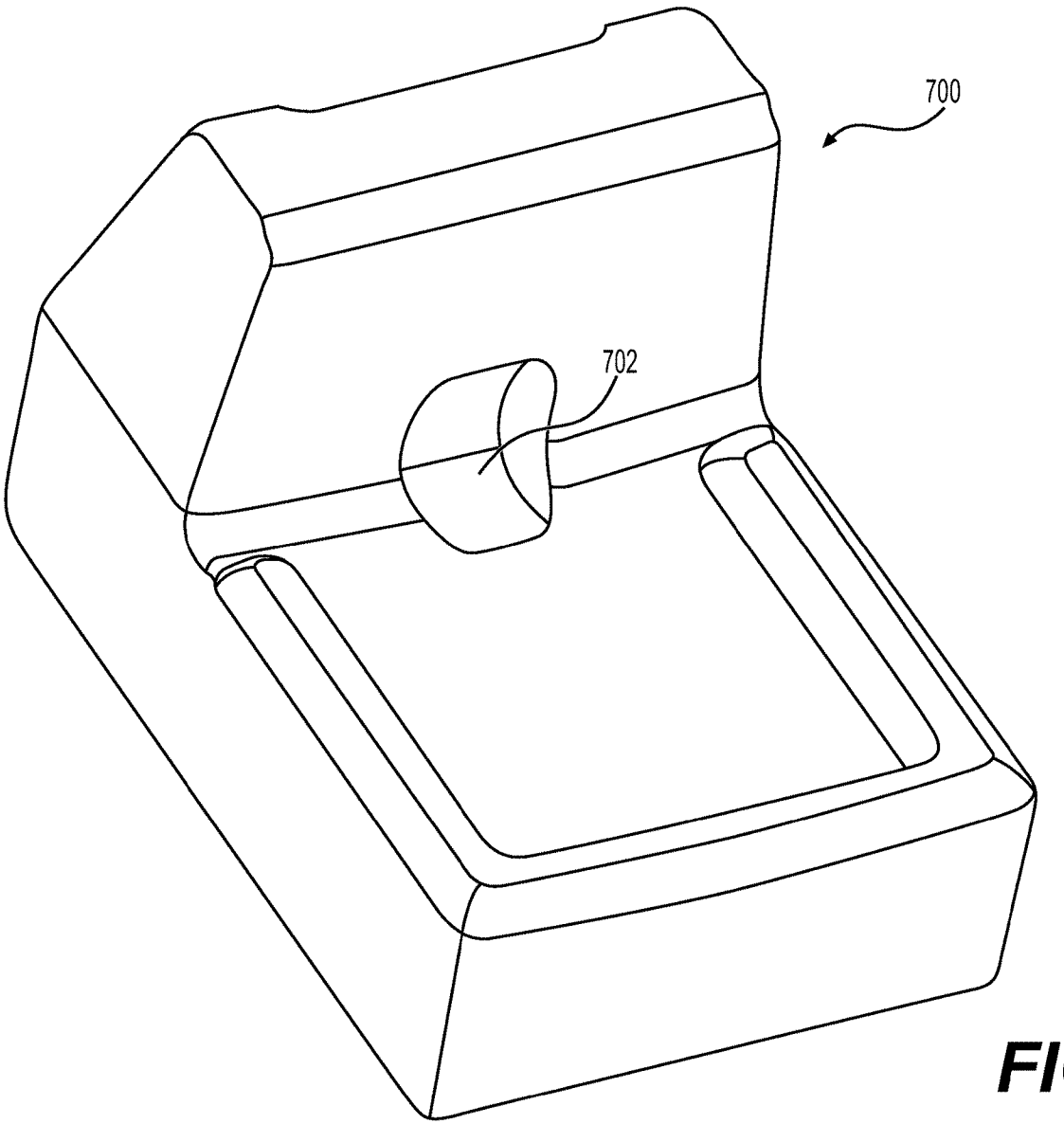
FIG. 10 shows a rear oriented perspective view of a heel shroud configured with a wear indicator positioned near the interior of the interior corner of the heel shroud.

The inventors have performed design iterations placing the wear indicator/stress reduction geometry at various locations of the heel shroud. For example, the wear indicator/stress reduction geometry (e.g., see cavity 702 of heel shroud 700 in FIG. 10 that provides a non-limiting example) was placed toward the interior of the interior corner of the heel shroud. The size, shape, and placement of the cavity was altered eleven times and then was placed at the outside lateral faces such as shown in FIG. 9. FEA showed that there was a 10% reduction of stress when the cavity was placed at the lateral faces of the heel shroud, while internal stresses only rose 3%, but were still far below acceptable values. Accordingly, one skilled in the art expects an improvement in the durability of the heel shroud.

In various embodiments, a heel shroud is designed with external wear indicators which are present on both left and right sides of the shroud. By placing the indicator's features on the left and right side of the external shroud geometry, the stress concentrations originally created by the internal indicator features have been removed (as shown through virtual heat treatment analysis). This solution provides guidance on when the shroud should be replaced by having visible wear indicators on both sides of the shroud and allows for estimating life left by having the indicators visible throughout the life of the shroud.

In other embodiments, wear protection of Laminated Wear Products (LWP) welds on heel shroud is provided. In general, a heel shroud is designed with designated locations to attach LWP and a protective feature in the form of ribs that surrounds the welds used to attach the LWP. This feature was designed to protrude out above the height of the welds used in this application to protect them from abrasive material and prolong the life of the LWP. This feature also acts as a designator for key locations to add LWP, which will maximize the life of the heel shroud. This feature also allows for the heel shroud to be used without LWP if needed. It can also protect overlays of different types, including Abrasion Resistant Material (ARM) and Plasma Transferred Arc (PTA) welding.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A heel shroud comprising:

a bottom leg; and a side leg extending from the bottom leg, forming an interior corner with the bottom leg, wherein the heel shroud defines a first lateral surface and a second lateral surface, wherein the bottom leg includes:

a curved interior surface extending from the first lateral surface to the second lateral surface at least partially forming the interior corner, and a flat bottom surface that defines a lower wear member receiving pocket, and wherein the side leg includes a side wear member receiving pocket that is bound by a first lateral rib at a first edge of the side leg and a second lateral rib at a second edge of the side leg, wherein the lower wear member receiving pocket and the side wear member receiving pocket are contiguous, forming a L-shaped cavity.

2. The heel shroud of claim 1, wherein the side leg defines an exterior planar surface that, and wherein the exterior planar surface defines the side wear member receiving pocket.

3. The heel shroud of claim 1, wherein the heel shroud defines a lateral width measured from the first lateral surface to the second lateral surface, wherein the L-shaped cavity defines a lateral cavity width, and wherein a ratio of the lateral width of the heel shroud to the lateral cavity width measures from 1.09 to 1.32.

4. The heel shroud of claim 1, wherein the L-shaped cavity is bound by the first lateral rib and the second lateral rib, and wherein the second lateral rib is symmetrical to the first lateral rib.

5. The heel shroud of claim 1, wherein the side leg further includes a tapered portion including an exterior top cavity that is disposed vertically above the side wear member receiving pocket, and wherein the exterior top cavity is separated from the side wear member receiving pocket.

6. The heel shroud of claim 1, further comprising a laterally extending wear member disposed in the side wear member receiving pocket.

7. The heel shroud of claim 6, wherein the laterally extending wear member is a chocky bar.

8. The heel shroud of claim 7, further comprising a mounting plate interposed between the side leg and the chocky bar.

9. The heel shroud of claim 1, further comprising a pair of transversely extending wear members disposed in the lower wear member receiving pocket.

10. The heel shroud of claim 9, further comprising a pair of mounting plates interposed between the bottom leg and the pair of transversely extending wear members.

11. The heel shroud of claim 10, wherein the pair of transversely extending wear members are chocky bars.

12. The heel shroud of claim 9, further comprising a lifting hook disposed laterally between the pair of transversely extending wear members.

13. The heel shroud of claim 9, further comprising a wear button disposed laterally between the pair of transversely extending wear members.

14. A heel shroud comprising:

a bottom leg; and a side leg extending orthogonally from the bottom leg, forming an interior corner with the bottom leg, wherein the heel shroud defines a first lateral surface and a second lateral surface, wherein the bottom leg includes:

a curved interior surface extending from the first lateral surface to the second lateral surface at least partially forming the interior corner, and wherein the first lateral surface defines a stress reduction geometry that is disposed at the interior corner and that includes a pocket, wherein the interior corner includes a concave arcuate surface that has a pocket floor surface, wherein the pocket extends from the concave arcuate surface, and wherein the concave arcuate surface has a pocket floor surface that is connected to the concave arcuate surface by a plurality of convex arcuate surfaces.

* * * * *